US005457355A

United States Patent [19]

Fleming et al.

[11] Patent Number: 5,457,355

[45] Date of Patent: Oct. 10, 1995

[54] ASYMMETRICAL FIELD EMITTER

[75] Inventors: James G. Fleming; Bradley K. Smith, both of Albuquerque, N.M.

[73] Assignee: Sandia Corporation, Albuquerque, N.M.

[21] Appl. No.: 160,705

[22] Filed: Dec. 1, 1993

[51] Int. Cl.[6] ..... H01J 1/46

[52] U.S. Cl. ..... 313/336; 313/309; 313/351

[58] Field of Search ..... 313/309, 310, 313/336, 351

[56] References Cited

U.S. PATENT DOCUMENTS

| | | | |
|---|---|---|---|
| 5,053,673 | 10/1991 | Tomii et al. | 313/336 |
| 5,170,092 | 12/1992 | Tomii et al. | 313/309 |
| 5,343,110 | 8/1994 | Kaneko et al. | 313/309 |

OTHER PUBLICATIONS

G. W. Jones et al., "Fabrication of Silicon Point, Wedge, and Trench FEAs", Technical Digest of IVMC91, Nagahama 1991, pp. 34–35.

J. E. Pogemiller et al., "Gated Chromium Volcano Emitters", IEEE Electron Devices Society Technical Digest, Sixth International Vacuum Microelectronics Conference, Newport, R. I., Jul. 12–15, 1993, pp. 68–69.

Mark H. Weichold et al., "Manufacturable Vacuum Field Emission Diodes", Journal of Vacuum Science Technology, vol. 11, No. 2, Mar./Apr. 1993, pp. 505–510.

*Primary Examiner*—Donald J. Yusko
*Assistant Examiner*—N. D. Patel
*Attorney, Agent, or Firm*—Peter P. Tong

[57] ABSTRACT

Providing a field emitter with an asymmetrical emitter structure having a very sharp tip in close proximity to its gate. One preferred embodiment of the present invention includes an asymmetrical emitter and a gate. The emitter having a tip and a side is coupled to a substrate. The gate is connected to a step in the substrate. The step has a top surface and a side wall that is substantially parallel to the side of the emitter. The tip of the emitter is in close proximity to the gate. The emitter is at an emitter potential, and the gate is at a gate potential such that with the two potentials at appropriate values, electrons are emitted from the emitter. In one embodiment, the gate is separated from the emitter by an oxide layer, and the emitter is etched anisotropically to form its tip and its asymmetrical structure.

5 Claims, 6 Drawing Sheets

ASYMMETRICAL FIELD EMITTER

The Government has rights to this invention pursuant to Contract Number DE-AC04-76DP00789 awarded by the United States Department of Energy.

BACKGROUND OF THE INVENTION

The present invention relates generally to electron sources and more particularly to asymmetrical field emitters on a substrate.

In numerous applications, solid state field emitters are replacing electron guns. There are many ways to build a solid state field emitter. FIGS. 1A–C show conceptually the process to build one type of field emitters. For that process, after the formation of the basic structure as shown in FIG. 1A, an emitter material is deposited as shown in FIG. 1B. Then the emitter material on top of the gate is removed to form the field emitter as in FIG. 1C. The diameter of the hole exposing the emitter is on the order of a few microns, and its proximity to the emitter has to be very well controlled. Another very important parameter is the size of the tip of the emitter. The tip should be very sharp in order to create a high electric field. Unfortunately, it is difficult to make very sharp tips based on the process shown.

FIGS. 2A–C show conceptually another process to make a field emitter. This method is based on a single crystalline silicon substrate. First, a part of a silicon substrate is masked as shown in FIG. 2A. Then the substrate is etched. Due to the anisotropic nature of the single crystalline silicon, a pyramid-shaped structure is formed under the mask. The mask is then removed leaving the pyramid-shaped structure to be the emitter, as shown in FIG. 2C. The pyramid can then be sharpened by oxidation. This type of field emitters depends on a single crystalline silicon substrate, which is quite difficult to have a substrate size large enough for applications in areas such as flat panel displays.

It should be apparent from the foregoing that there is still a need for a field emitter with a very sharp emitter in close proximity to its gate. Further, the field emitter should not be limited to be on a single crystalline silicon substrate.

SUMMARY OF THE INVENTION

The present invention provides a new type of field emitters with very sharp emitters in close proximity to their corresponding gates. Further, the field emitters do not have to be on a single crystalline silicon substrate.

The emitters in the present invention have tips on the order of tens of angstroms. The tips are self-aligned a few tenths of microns away from their corresponding gates. Some prior methods require very careful emitter deposition so that the tips of the emitters are sharp and close to their corresponding gates. The present invention ensures the sharpness of the emitters together with their proximity to their corresponding gates by the invented fabrication methods applied to the structures of the invention. Some prior methods require a single crystalline silicon substrate. The present invention does not have such limitation. Moreover, the field emitters do not have to be circular in shape; they can be very long straight lines, like the line emitters for flat panel displays.

One preferred embodiment of the present invention includes an asymmetrical emitter and a gate. The emitter has a tip, a side and is coupled to a substrate. The tip of the emitter is in close proximity to the gate, which is connected to a step on the substrate. The step has a side wall that is substantially parallel to the side of the emitter.

The emitter is at an emitter potential, and the gate is at a gate potential such that with the two potentials at appropriate values, electrons are emitted from the emitter.

One preferred process to form the above embodiment is first to form on a substrate a step, which has a top surface and a side wall. Then sequentially form a first electrode, an insulating layer and a second electrode on the top and the side surface. The first electrode is the gate, and the second electrode is to be used as the emitter. After the above formation, the second electrode is anisotropically etched so as to remove that part of the second electrode on the top surface, and to form an asymmetrical structure. After the etch, one surface of the asymmetrical structure is substantially parallel to the side wall, and the asymmetrical structure has a tip. Finally, partially remove the insulating layer to expose at least the tip of the asymmetrical structure.

Other aspects and advantages of the present invention will become apparent from the following detailed description, taken in conjunction with the accompanying drawings, illustrating by way of example the principles of the invention.

Same numerals in FIGS. 1 to 6 are assigned to similar elements in all the figures. Embodiments of the invention are discussed below with reference to FIGS. 1 to 6. However, those skilled in the art will readily appreciate that the detailed description given herein with respect to these figures is for explanatory purposes as the invention extends beyond these limited embodiments.

DETAILED DESCRIPTION OF THE INVENTION

Figure 1A:
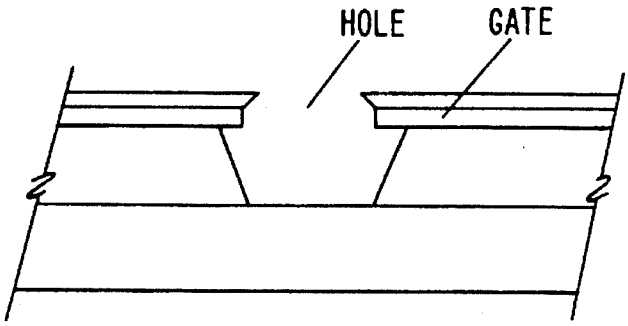
FIG-1A (PRIOR ART)
FIGS. 1A–1C show conceptually a process to make a prior art field emitter.
Figure 1B:
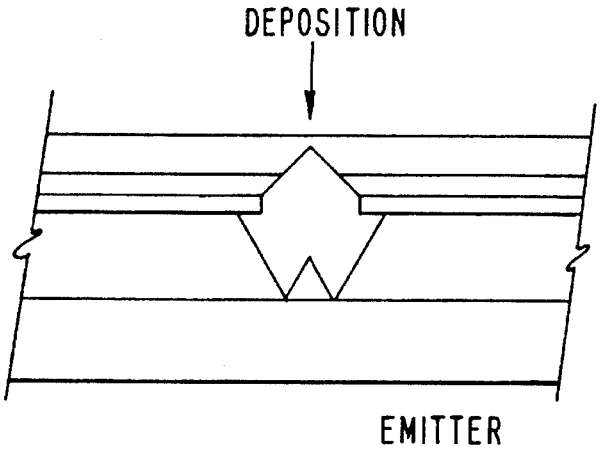
FIG-1B (PRIOR ART)
Figure 1C:
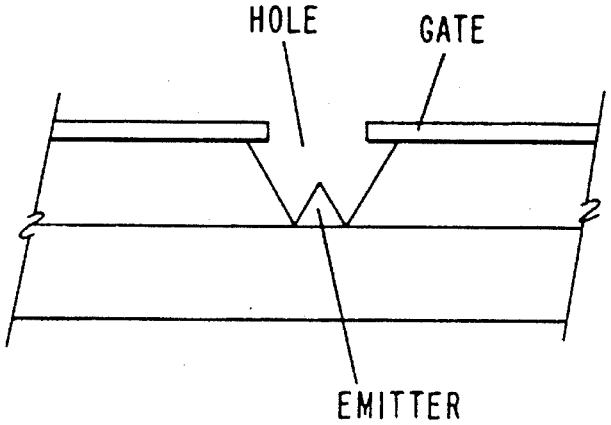
FIG-1C (PRIOR ART)
Figure 2A:
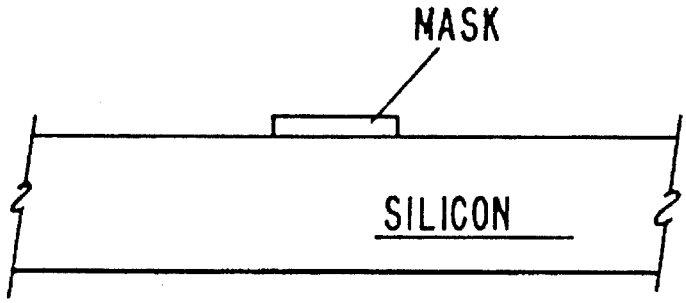
FIG-2A (PRIOR ART)
FIGS. 2A–2C show conceptually a process to make another prior art field emitter.
Figure 2B:
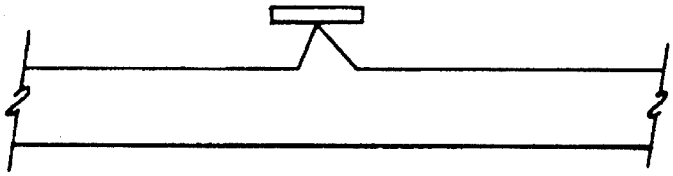
FIG-2B (PRIOR ART)
Figure 2C:
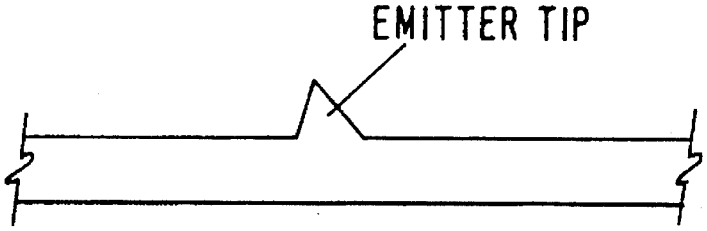
FIG-2C (PRIOR ART)
Figure 3A:
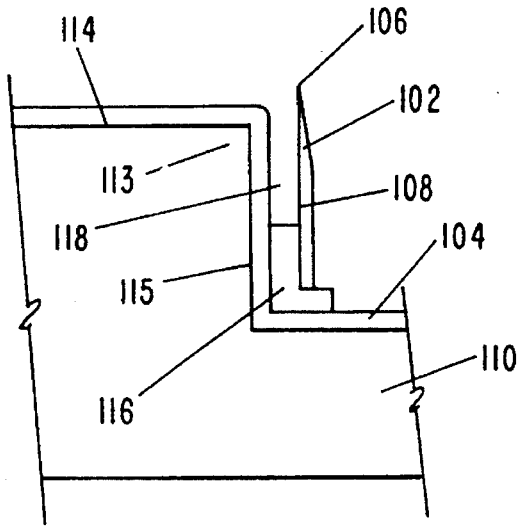
FIGS. 3A–3B show a first preferred embodiment of the present invention.
Figure 3C:
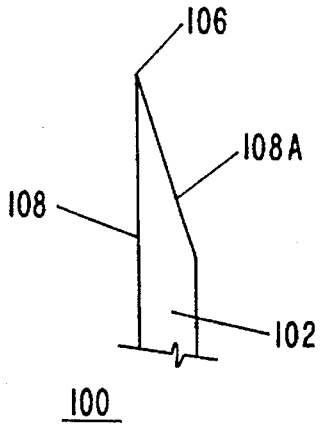
FIG. 3C is an expanded cross sectional view of the emitter tip shown in FIG. 3A.
Figure 3B:
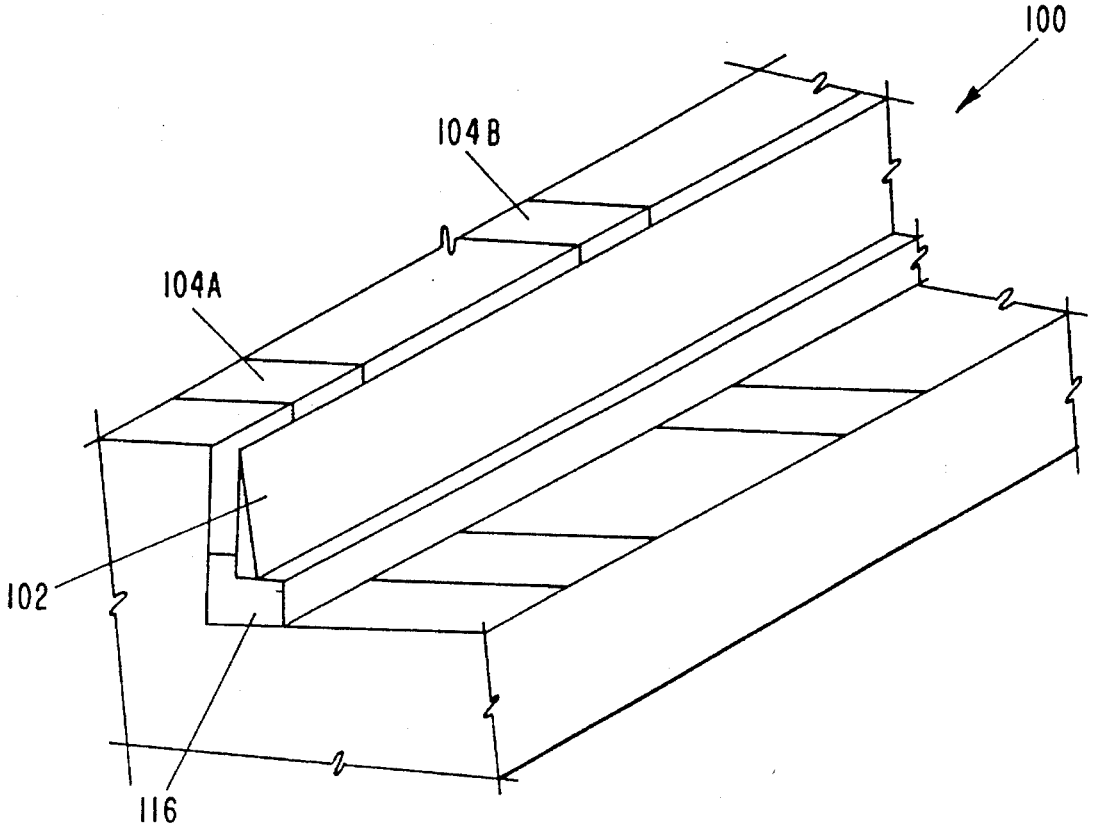

FIGS. 3A–B show a first preferred embodiment 100 of the present invention. FIG. 3A shows a cross-sectional view of the embodiment 100, which includes an asymmetrical emitter 102 and a gate 104. The emitter 102 has a tip 106, a first side 108, and preferably is in the shape of a wedge. It is asymmetrical because the first side 108 is substantially vertical while the opposing side 108A is at an angle from the vertical. In one preferred embodiment, the size of the tip is on the order of tens of angstroms, and the base of the emitter 102 is about 0.2 microns. The emitter is preferably made of a conductive or a semi-conductive material.

The emitter 102 is separated from the gate 104 by a small gap 118. The gap is partially filled by an insulating material 116. In one embodiment, the gap is on the order of 0.1 microns wide, and the gate 104 is in close proximity to the tip 106 of the emitter. The proximity is determined by the thickness of the insulating material 116.

The gate 104 is connected to a step 113 on a substrate 110. The step 113 has a top surface 114 and a side wall 115, which is substantially parallel to the first side 108 of the emitter. In one embodiment, the top surface 114 is substantially perpendicular to the side wall 115. Both the emitter 102 and the gate 104 are coupled to the substrate 110.

The emitter 102 is at an emitter potential, and the gate 104 is at a gate potential such that at appropriate levels, electrons are emitted from the emitter 102.

FIG. 3B shows an elevated view of a part of the preferred embodiment 100. The emitter 102 is a line emitter with gates 104A and 104B at selective positions. Different portions of the emitter 102 are turned on or off by the voltages on different gates.

Figure 4A:
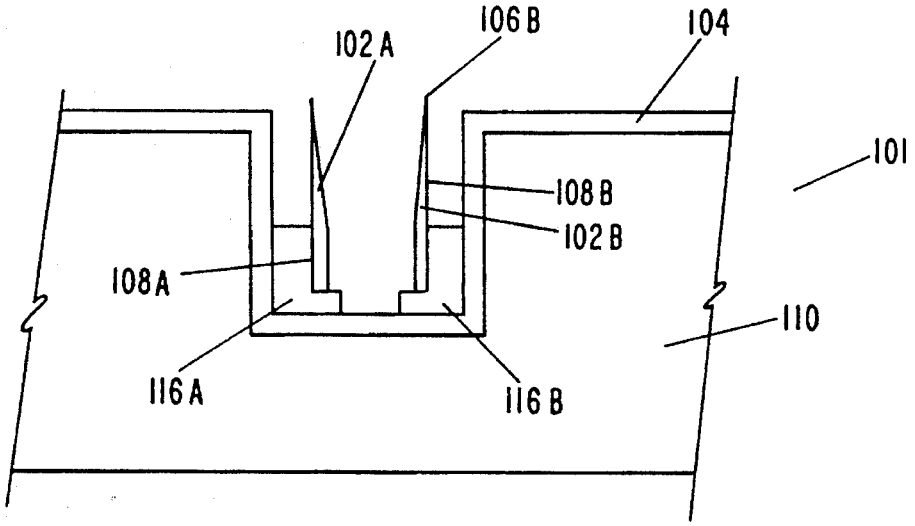
FIGS. 4A–4B show a second preferred embodiment of the present invention.

FIG. 4A shows a second preferred embodiment 101 of the present invention. In addition to the first emitter 102A, which is similar to the emitter in the first embodiment, the second embodiment has a second asymmetrical emitter 102B with a tip 106B and a side 108B. The side 108B is substantially parallel to the side 108A of the first emitter 102A. The tip 106B of the second emitter 102B is in close proximity to the gate 104. The second emitter 102B is at a second emitter potential such that at appropriate second emitter and gate potentials, electrons are emitted from the second emitter 102B.

Figure 4B:
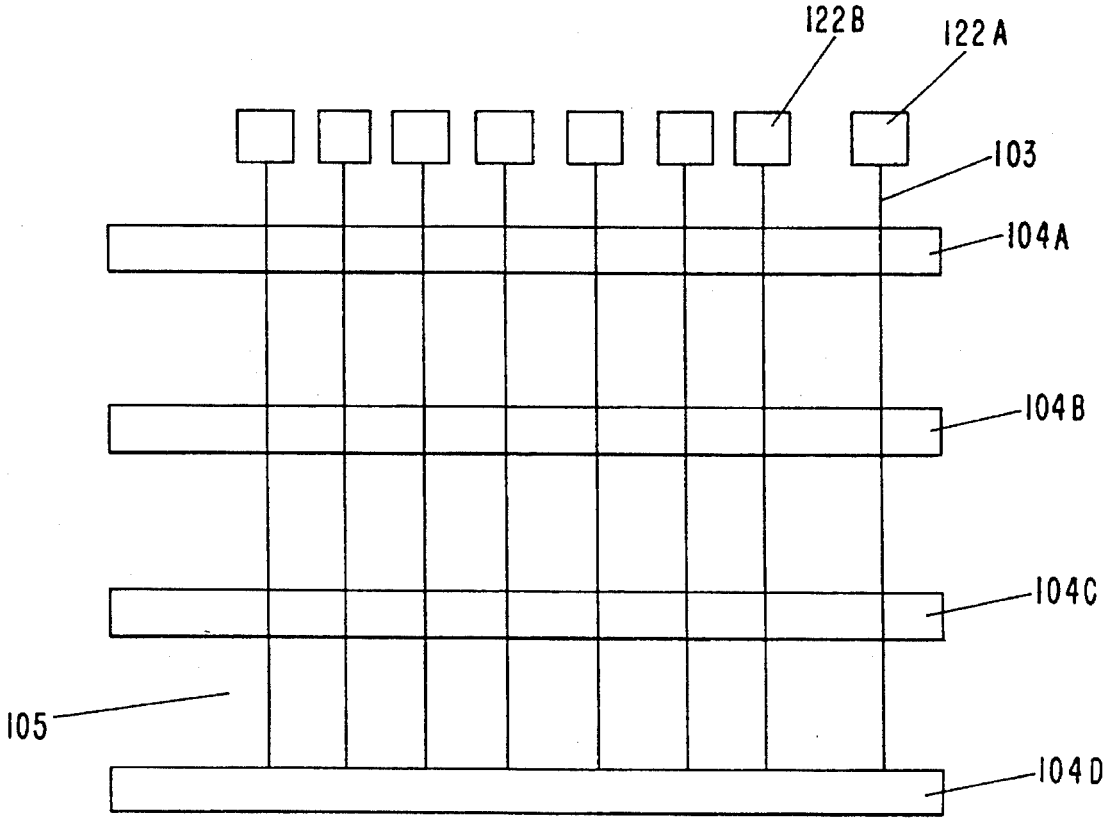

FIG. 4B shows the top view of a plurality of the second preferred embodiment 101. The figure shows four gates 104A to D and numerous line emitters, such as 103 and 105. Each line emitter is similar to the structure shown in FIG. 4A. The two field emitters of each line emitter are connected to an emitter pad to bias the line emitter to an appropriate voltage, for example, the line emitter 103 is connected to the emitter pad 122A.

FIGS. 5A–E show a preferred process to fabricate the second preferred embodiment 101. FIG. 6 shows the flow chart 200 of the preferred process shown in FIGS. 5A–E.

Figure 5A:
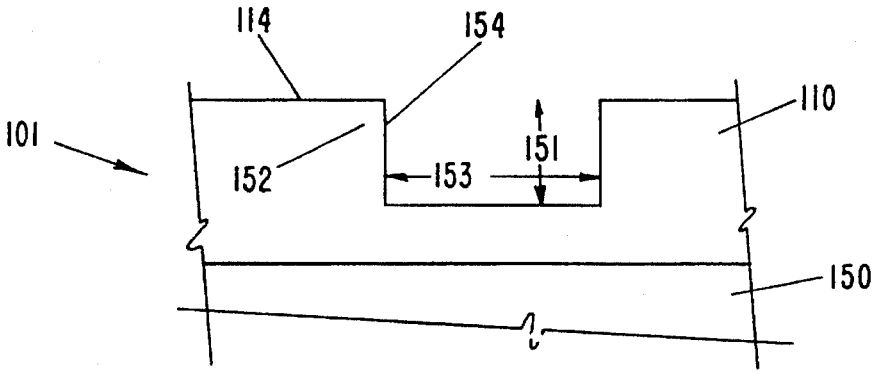
FIGS. 5A–5E show a preferred process to fabricate the second preferred embodiment of the present invention.
Figure 6:
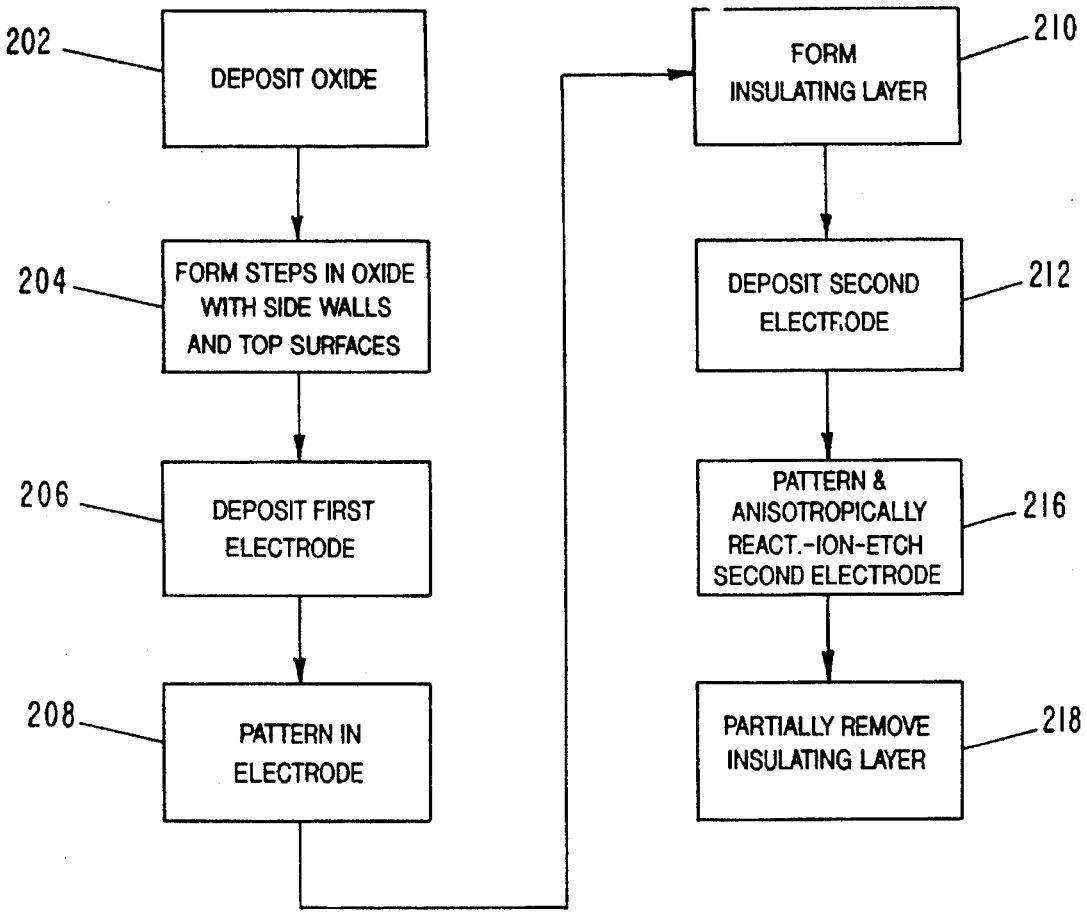
FIG. 6 shows the flow chart of the preferred process shown in FIGS. 5A–5E.

FIG. 5A shows the procedures 202 and 204. First, an oxide layer is deposited, 202, on a piece of material 150. The oxide layer serves as the substrate 110 for the embodiment 101. In one preferred embodiment, the oxide layer is about 2 microns thick. If the piece of material 150 is a good quality glass plate or other insulating material, no oxide layer is needed because the surface of the insulating material can serve as the substrate. After having the substrate 110, steps are formed, 204, in the substrate 110, for example, the step 152. The steps have side walls, such as 154, and top surfaces, such as 114. In one embodiment, the side walls are substantially perpendicular to the top surface, and the steps have a depth 151 of about 0.7 microns. The distance 153 between one step and the next is about 10 microns.

Figure 5B:
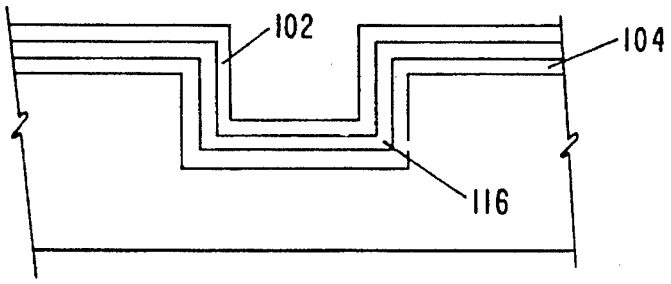

FIG. 5B shows the procedure 206 to 212. First, a first electrode is deposited, 206. In one embodiment, it is a doped polysilicon deposited insitu and has a thickness of about 0.2 microns. The first electrode is patterned, 208, by standard photolithographic technique into the gate structures, such as 104A and 104B as shown in FIG. 3B. In one embodiment, the gates are about 300 microns wide with a 20 microns spacing between two adjacent gates. A layer of insulating material, 116, is then deposited, 210. In one embodiment, the insulating material is an oxide layer about 0.1 to 0.3 microns thick. After the formation of the insulating layer, a second electrode is deposited, 212. In one embodiment, the second electrode is a doped polysilicon deposited insitu and has a thickness of about 0.2 microns.

Figure 5C:
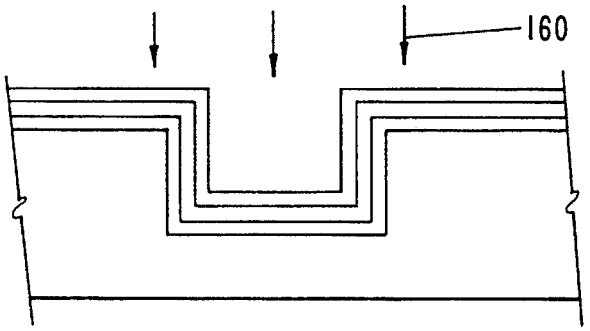
Figure 5D:
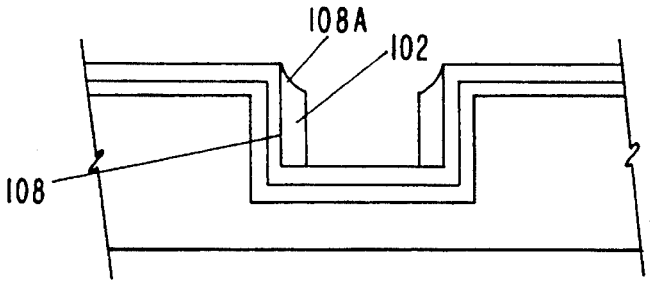

FIG. 5C shows the procedure 216 to pattern and anisotropically reactive-ion-etch the second electrode to form the emitter pads together with the emitter structure as shown in FIG. 5D. In one embodiment, the anisotropic etch is based on reactive-ion-etching techniques with a majority of the ions substantially flowing parallel to the side wall 154 of the step 152. The etching process is not detailed here but well-known to those skilled in the art. Due to the etching characteristics, the advantageous asymmetrical emitter structure with a sharp tip is fabricated. Moreover, the process self-aligns the tip of the emitter to be in close proximity to the gate because the tip of the emitter and the gate are substantially separated by the thickness of the insulating layer.

Figure 5E:
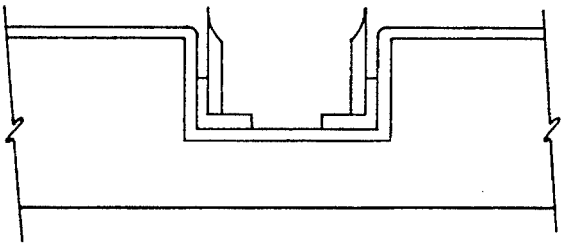

FIG. 5E shows the result of partially removing, 218, the insulating layer 116. In one embodiment, the insulating oxide layer is removed by HF. In this embodiment the insulating layer 116 is only partially removed, with some insulating layer remaining to support the emitter.

The first embodiment shown in FIGS. 3A–B is made by methods similar to those described above, except that during the procedure 216 of patterning and anisotropically reactive-ion-etching the second electrode, an additional mask is used so as to form one emitter structure instead of two. These masking techniques are not detailed here but well-known to those skilled in the art.

From the foregoing it will be appreciated that the present invention provides field emitters with very sharp tips (on the order of tens of angstroms) self-aligned and in close proximity to their corresponding gates. The structure can be built in an oxide layer or other similar insulating materials where steps can be formed and electrodes can be deposited.

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

We claim;

1. A field emission device including a field emitter, the field emitter comprising:

a first asymmetrical emitter with a tip and a side, the emitter being coupled to a substrate, and being at an emitter potential such that:

the substrate includes a top surface, a bottom surface and a side wall separating the two surfaces;

the top surface, the bottom surface and the side wall form a step; and the side wall is substantially parallel to the side of the emitter; and a gate connected to both the top and the bottom surface of the step, being in close proximity to the tip of the emitter, and being at a gate potential;

such that at appropriate emitter and gate potentials, electrons are emitted from the emitter.

2. A field emission device as recited in claim 1 further comprising an insulating material partially filling the gap that separates the gate from the emitter.

3. A field emission device as recited in claim 1 further comprising a plurality of field emitters, all substantially identical to the field emitter as recited in claim 1, wherein a gate of each emitter is coupled to a gate of each of the other emitters.

4. A field emission device as recited in claim 1 further comprising a second asymmetrical emitter with a tip and a side, the side of the second emitter being substantially parallel to the side of the first emitter, the tip of the second emitter being in close proximity to the gate, and the second emitter, at a second emitter potential, being coupled to the substrate;

such that at appropriate second emitter and gate potentials, electrons are emitted from the second emitter.

5. A field emission device as recited in claim 1 wherein the emitter is shaped like a wedge.

* * * * *